US007066585B2

(12) United States Patent
Kumagai

(10) Patent No.: US 7,066,585 B2
(45) Date of Patent: Jun. 27, 2006

(54) LIQUID EJECTING APPARATUS, TANK FOR EVACUATING LIQUID OF LIQUID EJECTING APPARATUS AND METHOD OF EVACUATING LIQUID OF LIQUID EJECTING APPARATUS

(75) Inventor: Toshio Kumagai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 39 days.

(21) Appl. No.: 10/651,289

(22) Filed: Aug. 29, 2003

(65) Prior Publication Data

US 2004/0119796 A1 Jun. 24, 2004

(30) Foreign Application Priority Data

Aug. 30, 2002 (JP) ..... 2002-255170

(51) Int. Cl.
*B41J 2/175* (2006.01)

(52) U.S. Cl. ..... 347/85

(58) Field of Classification Search ..... 347/29, 347/36, 84, 85, 86, 87
See application file for complete search history.

(56) References Cited

U.S. PATENT DOCUMENTS 4,476,472 A * 10/1984 Aiba et al. ..... 347/86
4,636,814 A * 1/1987 Terasawa ..... 347/86
5,801,736 A * 9/1998 Ikkatai et al. ..... 347/86
6,048,055 A * 4/2000 Hakkaku ..... 347/86
6,059,405 A * 5/2000 Mochizuki et al. ..... 347/92
6,267,474 B1 * 7/2001 Mochizuki ..... 347/86
6,293,662 B1 * 9/2001 Shihoh et al. ..... 347/86
6,196,655 B1 * 10/2001 Hirasawa et al. ..... 347/25
6,361,138 B1 * 3/2002 Seino et al. ..... 347/19
6,834,945 B1 * 12/2004 Ishizawa et al. ..... 347/86

FOREIGN PATENT DOCUMENTS

| | | |
|---|---|---|
| JP | 05-096741 | 4/1993 |
| JP | 2001-58416 | 3/2001 |
| JP | 2001-162838 | 6/2001 |
| JP | 2001-219579 | 8/2001 |
| JP | 2002-192710 | 7/2002 |
| JP | 0200220771 A * | 7/2002 |

* cited by examiner

*Primary Examiner*—Ahn T. N. Vo
(74) *Attorney, Agent, or Firm*—Sughrue Mion, PLLC

(57) ABSTRACT

A liquid ejecting apparatus, includes a main tank storing liquid, a liquid ejecting head ejecting the liquid toward a target, a liquid supply passage connecting the main tank with the liquid ejecting head for supplying the liquid, a subtank storing the liquid and supplying the liquid to the liquid ejecting head, and the subtank provided on the liquid supply passage, and a pressurizing unit supplying pressurized air to the liquid supply passage from the side of the main tank so that liquid in a liquid supply passage is evacuated to the subtank.

25 Claims, 6 Drawing Sheets

LIQUID EJECTING APPARATUS, TANK FOR EVACUATING LIQUID OF LIQUID EJECTING APPARATUS AND METHOD OF EVACUATING LIQUID OF LIQUID EJECTING APPARATUS

BACKGROUND OF THE INVENTION

The present invention relates to a liquid ejecting apparatus for refilling liquid from a main tank to a subtank via a liquid supply passage and supplying the liquid from the subtank to a liquid ejecting head, an evacuation tank for evacuating liquid used in the liquid ejecting apparatus and a method of evacuating liquid of the liquid ejecting apparatus.

Heretofore, a liquid ejecting apparatus for ejecting liquid toward a target from a nozzle of a liquid ejecting head, such as an ink-jet printer is known. Some ink-jet printers have configuration of a so-called off-carriage type in which an ink cartridge as main tank for storing ink as liquid is arranged on the side of the main body of the printer. For the ink cartridge, plural ink cartridges are provided every ink of each color such as black, cyan, magenta and yellow. In case the off-carriage type is adopted, the printer may be miniaturized and thinned in case an ink cartridge having large capacity is used for printing on large paper for example and to increase the degree of freedom in a layout of ink cartridges.

In the ink-jet printer of the off-carriage type, to stabilize the supply of ink, a subtank may be provided on an ink passage between an ink cartridge to a recording head as a liquid ejecting head. The subtank is mounted on a carriage, receives ink from the ink cartridge via a tube for refilling ink and supplies the ink to the recording head.

Recently, for an image formed by the ink-jet printer, high image quality is required and accordingly, the type of ink has a tendency to be increased. Such ink is different depending upon material, an additive agent, color and concentration, and is used in consideration of a record medium and a purpose. For example, black ink for forming a high quality of image on glossy paper and black ink for forming an image on plain paper by high-speed printing may be different in a type. To enhance a gray scale, black ink may be used in place of gray ink for example.

The types of ink are increased as described above and in the meantime, the number of ink passage of a subtank and a tube mounted in the ink-jet printer is limited. Therefore, it is required that inks of different types are used in the same ink passage. In such a case, after already used ink is fully evacuated from a passage, ink of a different type is required to be filled. Particularly, in the ink-jet printer of the off-carriage type, as the passage from the ink cartridge to the recording head is long, much ink remains in the ink passage and a process for evacuating ink is important.

For a method of evacuating residual ink in the ink passage, a method of refilling ink in the tube for refilling ink and in the subtank provided above the ink cartridge in a direction of gravity by flowing the ink according to the gravity to flow back it to the ink cartridge is proposed.

However, in the ink cartridge, so-called deaerated ink in which gas dissolved in ink is removed is stored. Therefore, this method has a problem that when ink is flowed back, bubbles remained in the ink passage are mixed with the deaerated ink in the ink cartridge and the quality of ink is deteriorated.

Besides, a method of gathering the flowed back ink to a dedicated waste liquid tank is proposed. However, quantity of ink stored in the waste liquid tank is limited.

Besides, in the method of flowing back ink according to only gravity, a small ink droplet adheres to the inside wall of the tube for refilling ink cannot be evacuated. Besides, the ink passage has a location where it is difficult to evacuate residual ink according to only gravity and has a problem that ink is left.

SUMMARY OF THE INVENTION

The object of the invention is to provide a liquid ejecting apparatus in which liquid in a liquid passage of the liquid ejecting apparatus can be evacuated without deteriorating the quality of liquid in a main tank, a liquid evacuating tank of the liquid ejecting apparatus and a liquid evacuating method of the liquid ejecting apparatus.

Besides, another object of the invention is to provide a liquid ejecting apparatus in which in replacing main tanks, the evacuating performance of liquid in the liquid ejecting apparatus is enhanced, a liquid evacuating tank of the liquid ejecting apparatus and a liquid evacuating method of the liquid ejecting apparatus.

In order to achieve the above object, according to the present invention, there is provided a liquid ejecting apparatus comprising:

a main tank, storing liquid;

a liquid ejecting head, ejecting the liquid toward a target;

a liquid supply passage, connecting the main tank with the liquid ejecting head for supplying the liquid;

a subtank, storing the liquid and supplying the liquid to the liquid ejecting head, and the subtank provided on the liquid supply passage; and a pressurizing unit, supplying pressurized air to the liquid supply passage from the side of the main tank so that liquid in a liquid supply passage is evacuated to the subtank.

Preferably, the liquid evacuated to the subtank is evacuated in a waste liquid tank via a capping member for capping the liquid ejecting head through the liquid ejecting head from the subtank.

Preferably, the pressurizing unit supplies the pressurized air intermittently.

Preferably, the liquid ejecting apparatus further comprises an evacuation tank for evacuating liquid for supplying the pressurized air from the pressurized air to the liquid supply passage. The liquid is ejected by replacing the main tank with the evacuation tank.

Here, it is preferable that, the shape of the evacuation tank is the same as that of the main tank.

Here, it is preferable that, a filter is provided in the evacuation tank.

Here, it is preferable that, the main tank and the evacuation tank are provided with identifying members respectively, each of the identifying members has identification information for identifying each tank. The liquid ejecting apparatus is provided with a reading member for reading the identification information of the identifying member.

Preferably, the liquid ejecting apparatus further comprises a carriage, reciprocating in a direction of the width of the target. The liquid ejecting head and the subtank are mounted on the carriage.

According to the present invention, there is also provided an evacuation tank for evacuating liquid used in a liquid ejecting apparatus provided with a main tank for storing liquid, a liquid ejecting head for ejecting liquid toward a target, a liquid supply passage for supplying liquid in the main tank to the liquid ejecting head, a subtank, provided on the liquid supply passage, for storing the liquid on the liquid supply passage and supplying the liquid to the liquid ejecting head, and pressurizing unit supplying pressurized air to the main tank. The evacuation tank is replaceable with the main tank and is connected to the liquid supply passage. The pressurized air is supplied to the liquid supply passage through the evacuation tank so that liquid in the liquid supply passage is evacuated to the subtank.

Preferably, the shape of the evacuation tank is the same as that of the main tank.

Preferably, the evacuation tank is provided with a filter.

Preferably, the evacuation tank is provided with an identifying member having identification information for identifying the tank.

According to the present invention, there is also provided a method of evacuating liquid of a liquid ejecting apparatus, comprising the steps of:

providing a main tank for storing liquid;

providing a liquid ejecting head for ejecting liquid toward a target;

providing a liquid supply passage for supplying liquid in the main tank to the liquid ejecting head;

providing a subtank for storing the liquid and supplying the liquid to the liquid ejecting head, and the subtank provided on the liquid supply passage; and supplying pressurized air to the liquid supply passage from the side of the main tank so that liquid in a liquid supply passage is evacuated to the subtank.

Preferably, the method further comprises the step of evacuating the liquid in the subtank to a waste liquid tank via a capping member for capping the liquid ejecting head through the liquid ejecting head.

Preferably, the pressurized air is intermittently supplied to the liquid supply passage in the supplying step.

Preferably, the method further comprises the step of replacing the main tank with an evacuation tank for supplying the pressurized air to the liquid supply passage.

Here, it is preferable that, the shape of the evacuation tank is the same as that of the main tank.

Here, it is preferable that, the method further comprises the step of filtering the pressurized air in the evacuation tank.

Here, it is preferable that, the method further comprises the step of identifying which of the main tank and the evacuation tank is attached on the liquid ejecting apparatus.

Here, it is preferable that, the method further comprises the step of:

providing identifying members provided on the main tank and the evacuation tank respectively;

providing a reading member provided on the liquid ejecting apparatus;

reading identification information stored in the identifying member for identify each of tanks.

Here, it is preferable that, the supplying step is performed when the evacuation tank is identified in the identifying step.

Here, it is preferable that, the supplying step is performed after a signal for verifying an execution of liquid evacuation is received.

Here, it is preferable that, the supplying step and the evacuating step are alternately executed.

Here, it is preferable that, the supplying step and the evacuating step are simultaneously executed.

Here, it is preferable that, the liquid ejecting head and the subtank are mounted on a carriage which reciprocates in a direction of the width of the target.

In the above configurations and methods, the liquid in the liquid passage from the liquid supply passage to the subtank can be evacuated by the pressured air generated by the pressurizing unit from the side of the main tank. Besides, as liquid is not made to flow counter to exhaust, bubbles can be prevented from being mixed in liquid stored in the main tank. Therefore, the deterioration of the quality of liquid can be prevented. Besides, liquid left in the liquid supply passage can be more securely evacuated with pneumatics. Besides, as liquid does not flow counter into the evacuation tank, the evacuation tank can be repeatedly used.

In the above configurations and methods, liquid evacuated by the evacuation tank is evacuated in the waste liquid tank via the capping memer for capping the liquid ejecting head through the liquid ejecting head from the subtank. Therefore, as the waste liquid tank used for cleaning the liquid ejecting head can be utilized, another waste liquid tank is not required to be provided.

In the above configurations and methods, pressurized air is supplied by the pressurizing unit intermittently. This reason is that as liquid left in the subtank may bubble in case air is continuously taken, the bubbling of the liquid in the subtank can be possibly reduced by intermittently supplied air.

In the above configurations and methods, the evacuation tank is replaced with the main tank and the pressurized air supplied by the pressurizing unit can be directly supplied to the liquid supply passage by the evacuation tank. Therefore, the evacuation tank can be housed in space for housing the main tank and liquid can be efficiently evacuated.

In the above configurations and methods, the shape of the evacuation tank is the same as that of the main tank. Therefore, the evacuation tank can be easily housed in the space for housing the main tank. Besides, another space for housing the evacuation tank is not required to be provided.

In the above configurations and methods, the filter is provided to the evacuation tank. Therefore, the mixture of a foreign matter in the liquid supply passage can be reduced by filtering air from the pressurizing unit.

In the above configurations and methods, the identifying member is provided on the evacuation tank. Therefore, it can be discriminated by the reading member provided to the liquid ejecting apparatus whether the evacuation tank is mounted or not.

In the above methods, when the evacuation tank is detected by the reading member, the pressurized air is supplied. Therefore, the identification information can be effectively utilized and only in a required case, liquid can be evacuated.

In the above methods, when the evacuation tank is detected by the reading member, the pressurized air is supplied after a signal for verifying the evacuation of liquid is received. Therefore, as liquid can be evacuated after the signal for verifying the execution of the evacuation of liquid by the expression of a user's intention is received, wrong operation by the user can be reduced.

In the above methods, a process for evacuating liquid in the liquid passage from the liquid supply passage to the subtank by supplying the pressurized air from the side of the main tank and a process for ejecting liquid in the subtank via the liquid ejecting head and evacuating it in the waste liquid tank via the capping member are alternately executed. Therefore, liquid can be evacuated, regulating pressure in the liquid supply passage and the subtank. Besides, bubbling inside the subtank can be inhibited.

In the above methods, a process for evacuating liquid in the liquid passage from the liquid supply passage to the subtank by supplying the pressurized air from the side of the main tank and a process for ejecting liquid in the subtank via the liquid ejecting head and evacuating it in the waste liquid tank via the capping member are simultaneously executed. Therefore, time required for the process for evacuating liquid can be reduced.

In the above configurations and methods, the liquid ejecting head is mounted on the carriage, is reciprocated in the direction of the width of a target and ejects liquid, and the subtank is mounted on the carriage together with the liquid ejecting head. Therefore, in the liquid ejecting apparatus having the above-mentioned configuration, the action and the effect of the invention according to each aspect can be acquired.

In the above configurations and methods, liquid in the liquid supply passage of the liquid ejecting apparatus can be evacuated without deteriorating the quality of liquid in the main tank. Besides, when main tanks are replaced, the evacuating performance of liquid in the liquid ejecting apparatus can be enhanced.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Referring to FIGS. 1 to 6, an embodiment of an ink-jet printer as a liquid ejecting apparatus in which the invention is embodied will be described below.

Figure 1:
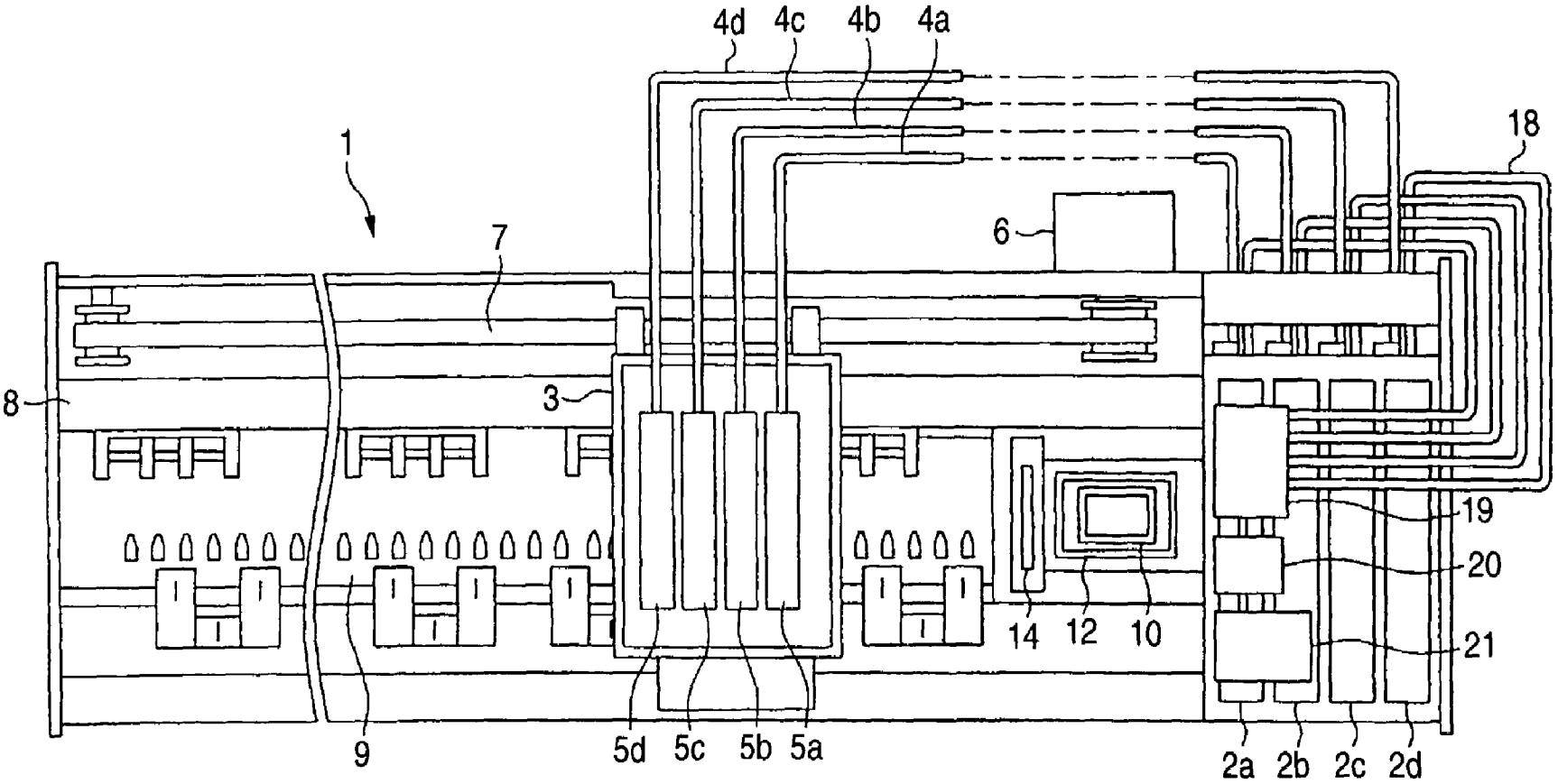
FIG. 1 is a schematic plan showing the body of an ink-jet printer equivalent to one embodiment.

FIG. 1 is a schematic plan showing the body 1 of the ink-jet printer provided in a case (not shown) of the ink-jet printer. In the body 1 of the ink-jet printer, ink cartridge portions 2*a* to 2*d* as a main tank are provided. In the ink cartridge portions 2*a* to 2*d*, ink cartridges 15*a* to 15*d*, a holder 32 and guide plates 33, 34 (see FIG. 4) are provided and are arranged in an non-printing area. The ink cartridge portion 2 is provided by the number of colors of used ink and in this embodiment, four ink cartridge portions 2*a* to 2*d* are provided. Ink packs 16*a* to 16*d* (see FIG. 2) storing ink are provided in the ink cartridge portion 2, and ink is refilled from the ink packs 16*a* to 16*d* to subtanks 5*a* to 5*d* via refill tubes 4*a* to 4*d*.

The subtanks 5*a* to 5*d* are provided on a carriage 3 corresponding to the number of ink of each color. In this embodiment, the total four subtanks 5*a* to 5*d* are mounted on the carriage 3. These subtanks 5*a* to 5*d* are configured so that ink refilled via the refill tube 4 can be supplied to a recording head 30 (see FIG. 2) as a liquid ejecting head mounted on the lower surface of the carriage 3.

The carriage 3 on which the subtanks 5*a* to 5*d* are mounted is driven by a carriage motor 6. The carriage is guided by a scanning guide member 8 via a timing belt 7 and is reciprocated in a horizontal scanning direction which is a longitudinal direction of a paper feed member 9, that is, a direction of the width of recording paper.

In the meantime, in the non-printing area on a path on which the carriage 3 is moved, a capping member 10 as capping means, a suction pump 11 (see FIG. 2) and a waste liquid tank 12 are arranged. The capping member 10 is formed by flexible material such as rubber. The capping member seals the nozzle formation face 30*a* of the recording head 30 when the carriage 3 is moved to the non-printing area. Therefore, the capping member 10 functions as a cap for preventing a nozzle aperture of the recording head from drying while the ink-jet printer halts. The bottom of the capping member 10 is connected to the suction pump 11 via a tube 13 (see FIG. 2). These capping member 10 and suction pump 11 are configured so that negative pressure caused by the suction pump 11 acts upon the recording head 30 and ink can be discharged from the side of the recording head 30. Further, on the side of a printing area of the capping member 10, a wiping member 14 made of elastic material such as rubber is arranged. The wiping member 14 wipes and cleans the nozzle formation face 30*a* of the recording head 30, if necessary.

Figure 2:
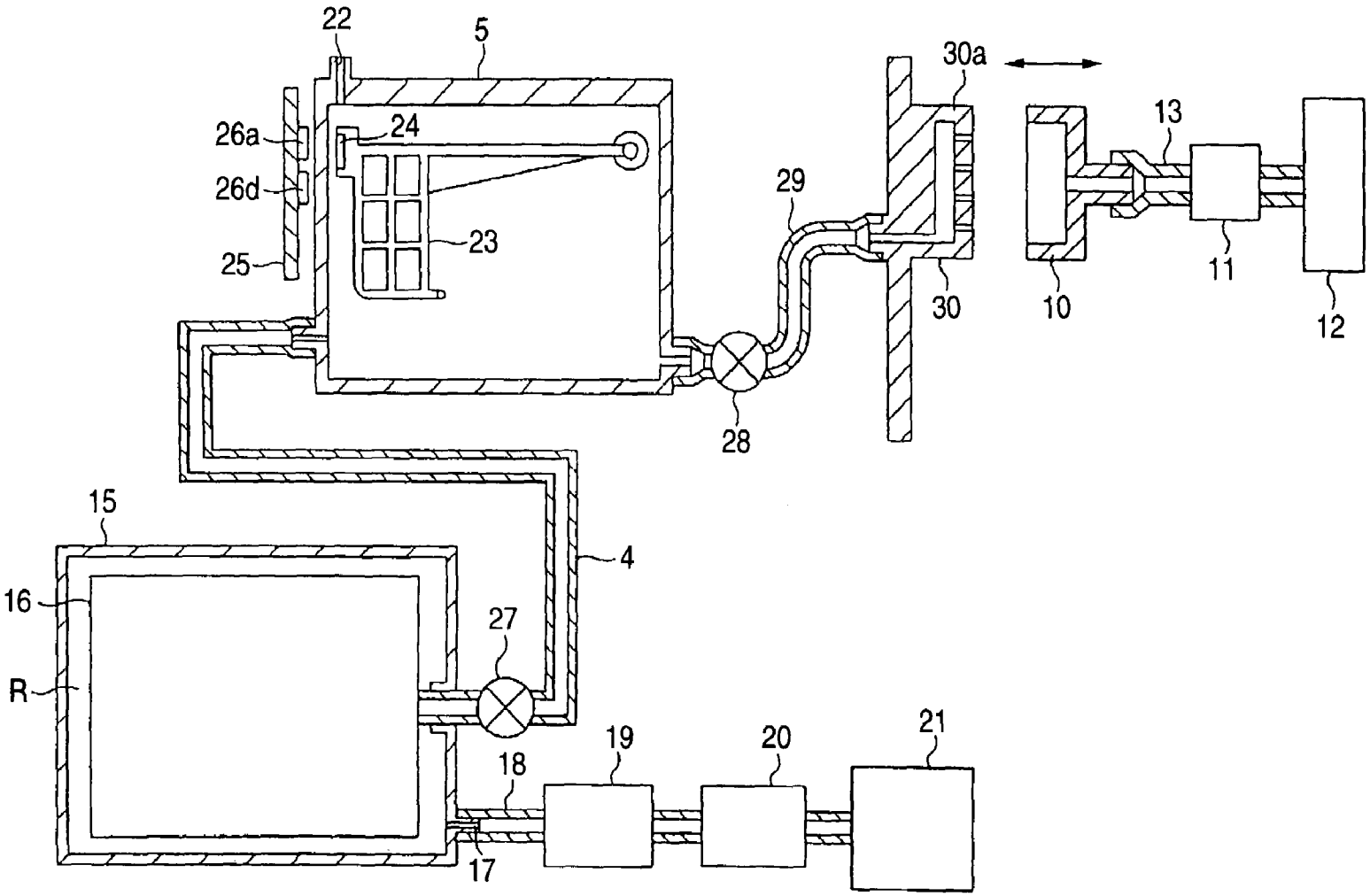
FIG. 2 is a schematic drawing showing a passage of ink in the ink-jet printer equivalent to the embodiment.

FIG. 2 schematically shows the configuration of an ink passage of the body 1 of the ink-jet printer shown in FIG. 1. FIG. 2 shows the ink cartridge 15, the ink pack 16, the subtank 5, the refill tube 4 and a supply tube 29 respectively configuring the passage corresponding to one color for convenience. The ink cartridge 15 includes ink as liquid. In this embodiment, the ink cartridges 15*a* to 15*d*, ink packs 16*a* to 16*d*, the subtanks 5*a* to 5*d* and the refill tubes 4*a* to 4*d* respectively of a number corresponding to each color of ink are provided in the body 1 of the ink-jet printer. The refill tube 4 and the supply tube 29 form a liquid supply passage.

As shown in FIG. 2, the ink pack 16 is housed in the ink cartridge 15 as described above. The ink pack 16 is formed by a flexible member. A pressure chamber R is formed in space between the ink pack 16 and the ink cartridge 15. An inlet 17 for taking air into the pressure chamber R is formed in the ink cartridge 15.

A pressure detector 19, a pressure regulating valve 20 and a pressurizing pump 21 are connected to the inlet 17 via a pressurizing tube 18. The pressurizing tube 18, the pressure detector 19, the pressure regulating valve 20 and the pressurizing pump 21 form a pressurizing unit. Besides, the pressurizing tube 18, the pressure detector 19, the pressure regulating valve 20 and the pressurizing pump 21 are controlled by pressurizing unit controller not shown. One pressure detector 19 and one pressure regulating valve 20 are provided in the body 1 of the ink-jet printer. Air pressurized by the pressurizing pump 21 is supplied to the pressure regulating valve 20 and is taken in the pressure chamber R of the ink cartridge 15 via the pressure detector 19. The pressure detector 19 is provided with a function for detecting air pressure generated by the pressurizing pump 21 and controlling the drive of the pressurizing pump 21 so that air pressure applied to each ink cartridge 15 are maintained in a predetermined range. The pressure regulating valve 20 is provided with a function for releasing pressure when air pressure pressurized by the pressurizing pump 21 reach an excessive state and maintaining air pressure applied to each ink cartridge 15 in the predetermined range. The pressure regulating valve 20 acts so that the ink cartridge 15 is prevented from being broken by pressurized air sent from the pressurizing pump 21 when any fault is caused in the pressure detector 19 and a control system of the pressurizing pump 21. Therefore, when the refilling of ink is started, the pressurizing pump 21 is operated and air pressurized by the pressurizing pump 21 passes the pressure regulating valve 20 and the pressure detector 19. If air pressure at this time are large than the predetermined range, a signal for stopping the operation of the pressurizing pump is output. If the air pressure are within the predetermined range, pressurized air flows into the pressure chamber R, the ink pack 16 is pressurized and ink is refilled in the subtank 5.

Ink refilled from the ink cartridge 15 is temporarily stored in the subtank 5. An air vent 22 is formed in the uppermost part in a direction of gravity of the subtank 5 and holds pressure in the subtank 5 equal to atmospheric pressure. Besides, inside the subtank 5, a floating member 23 is attached and a permanent magnet 24 is fixed to one end thereof. A substrate 25 is provided outside one side of the subtank 5 opposite to the permanent magnet 24 and magnetoelectric conversion devices 26*a*, 26*b* represented by Hall element are provided on the substrate 25. These magnetoelectric conversion devices 26*a*, 26*b* are arranged so that the dose of magnetic force produced by the permanent magnetic 24 can be detected and output an electric signal proportional to the detected dose of magnetic force.

When a quantity of ink stored in the subtank 5 is reduced, the floating member 23 moves downward in the direction of gravity. As the floating member moves, the dose of magnetic force received by the magnetoelectric conversion devices 26*a*, 26*b* from the permanent magnetic 24 varies. Therefore, the variation of an electric signal output by the magnetoelectric conversion device 26*a*, 26*b* can be sensed as the decrease of the quantity of ink stored in the subtank 5. As described above, when a signal indicating the decrease of the quantity of ink is output, a refill valve 27 is opened and ink is refilled in the subtank 5. In case the quantity of ink in the subtank 5 reaches predetermined capacity, the refill valve 27 is closed according to an electric signal from the magnetoelectric conversion devices 26*a*, 26*b* and no more ink is refilled in the subtank 5.

Ink temporarily stored in the subtank 5 is supplied to the recording head 30 mounted on the lower surface of the carriage 3 via the supply valve 28 and the supply tube 29. The ink supplied to the recording head 30 is ejected from the nozzle formation face 30*a* of the recording head 30.

Figure 3:
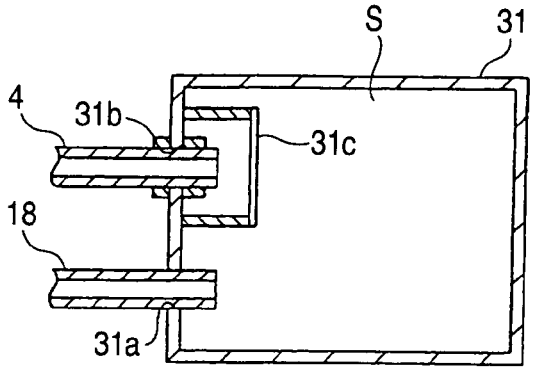
FIG. 3 is a sectional view showing a cartridge for exhaust in the embodiment.

Next, referring to FIGS. 3 and 4, a evacuation cartridge 31 as liquid evacuating member and an evacuation tank for evacuating liquid used in case different ink is replaced will be described. FIG. 3 is a sectional view showing the evacuation cartridge 31 and FIG. 4 is an exploded perspective view.

The shape of the evacuation cartridge 31 is formed like that of the ink cartridge 15. However, the evacuation cartridge 31 houses no ink pack inside differently from the ink cartridge 15 and includes only space S. An air intake 31*a* for inserting the pressurizing tube 18 connected to the pressure detector 19 and an air outlet 31*b* for sending air that flows into the space S to the side of the subtank 5 are formed on one side of the evacuation cartridge 31. A filter 31*c* as filtering means is provided around the air outlet 31*b* so that dust carried from the pressurizing pump 21 is prevented from being carried in the refill tube 4 via the air outlet 31*b*.

Figure 4:
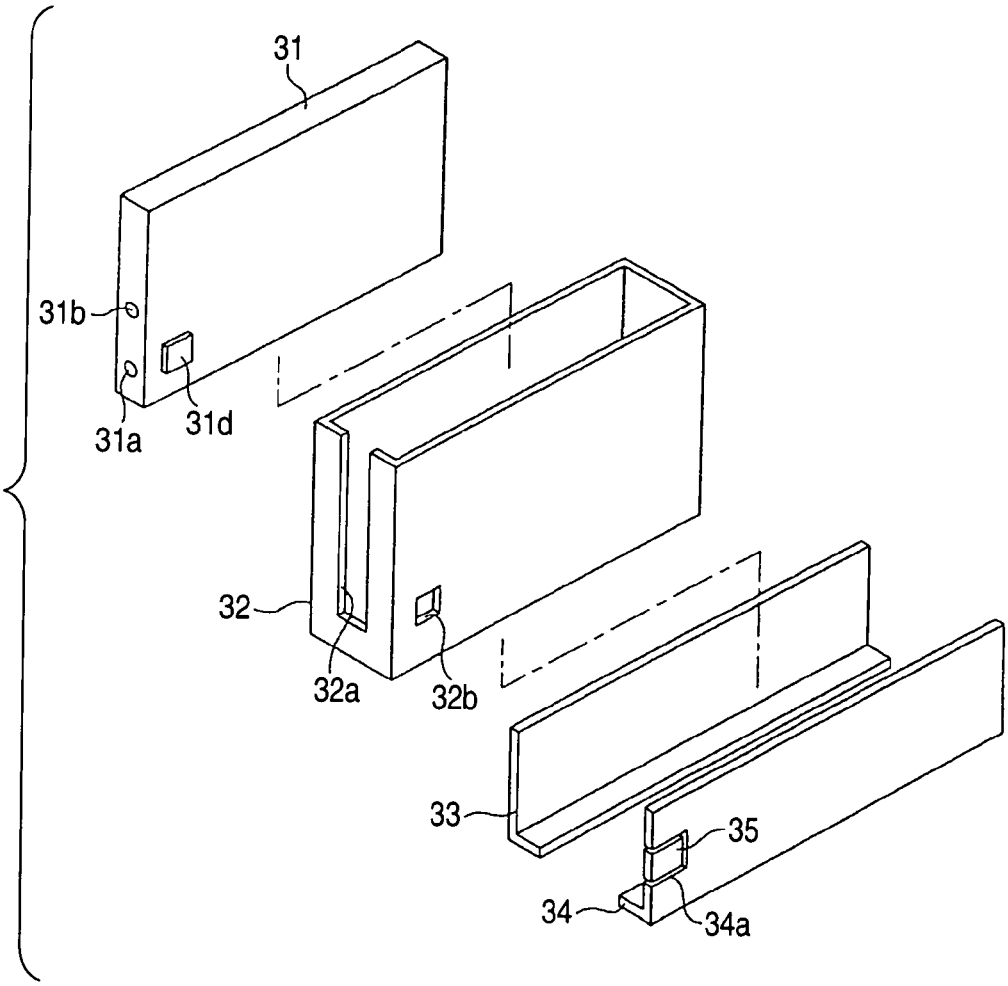
FIG. 4 is an exploded perspective view showing the cartridge for exhaust in the embodiment.

As shown in FIG. 4, an IC memory 31*d* as identifier is attached at end of the evacuation cartridge 31. In the IC memory 31*d*, identification information proper to the cartridge for exhaust is stored. In the ink cartridges 15*a* to 15*d*, the similar IC memory is respectively attached, and identification information proper to each ink cartridge and attribute information such as the type of ink are stored.

The evacuation cartridge 31 is housed in a holder 32. Also, the holder 32 is held and fixed by the guide plates 33, 34. The holder 32 and the guide plates 33, 34 are also provided in the ink cartridge 15. An output port 32*a* is formed on one side of the holder 32 since the evacuation cartridge 31 is housed in the holder 32 while connecting the refill tube 4 and the pressurizing tube 18 with the evacuation cartridge 31 and the ink cartridge 15. A window 32*b* is formed at an end of the holder 32. This window 32*b* is formed so that the IC memory is exposed outside the holder 32 when the cartridge is housed in the holder 32. The guide plates 33, 34 are fixed and supported to the body 1 of the ink-jet printer and hold and fix the holder 32. A concave portion 34*a* is formed at one end of the guide plate 34. The concave portion 34*a* is formed in a position opposite to the window 32*b* of the holder 32 when the holder 32 is mounted on the guide plates 33, 34. A data communication device 35 as reading a member reading data in the IC memory 31*d* is built in the concave portion 34*a*. When the holder 32 housing the cartridge is held and fixed between the guide plates 33, 34, the data communication device 35 can read data in the IC memory 31*d* via the window 32*b*.

In the meantime, on the surface of a case (not shown) of the ink-jet printer, a display and switches are formed. The ink-jet printer can be made to execute operation such as printing and maintenance by pressing the switches. The operation can be instructed from a computer connected to the ink-jet printer.

Figure 5:
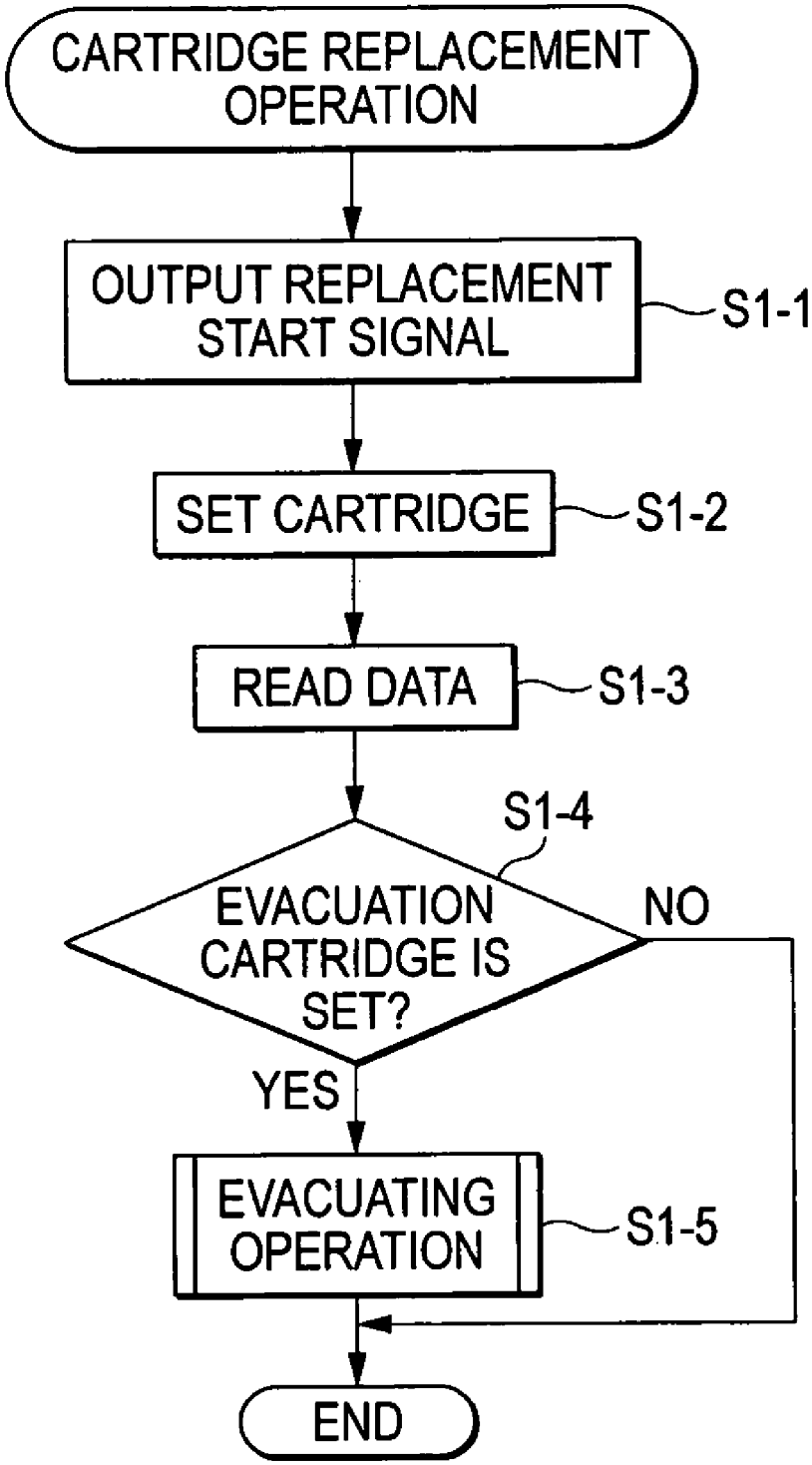
FIG. 5 is a flowchart showing a procedure of cartridge replacement operation in the embodiment.

Next, referring to FIG. 5, a procedure for replacing cartridges will be described. To replace cartridges, a user first presses a switch provided to the case for replacing cartridges. Or the user issues an instruction for replacing the cartridge 15 from a computer (not shown) connected to the ink-jet printer. An ink replacement start signal is output by the operation (S1-1).

Next, the user detaches the already set ink cartridge 15 and sets another cartridge in the holder 32 (S1-2). When the cartridge is set in the holder 32, data stored in the IC memory provided on the cartridge is read by the data communication device 35 (S1-3). It is judged whether the set cartridge is the evacuation cartridge 31 or not (S1-4). That is, it is judged whether the set cartridge is the evacuation cartridge 31 or not based upon whether there is an identifier of the evacuation cartridge 31 in the read data or not. In case the set cartridge is the ink cartridge 15 (NO in S1-4), cartridge replacement operation is finished without an ink evacuating operation. In case the set cartridge is the evacuation cartridge 31 (YES in S1-4), the ink evacuating operation is executed (S1-5).

Figure 6:
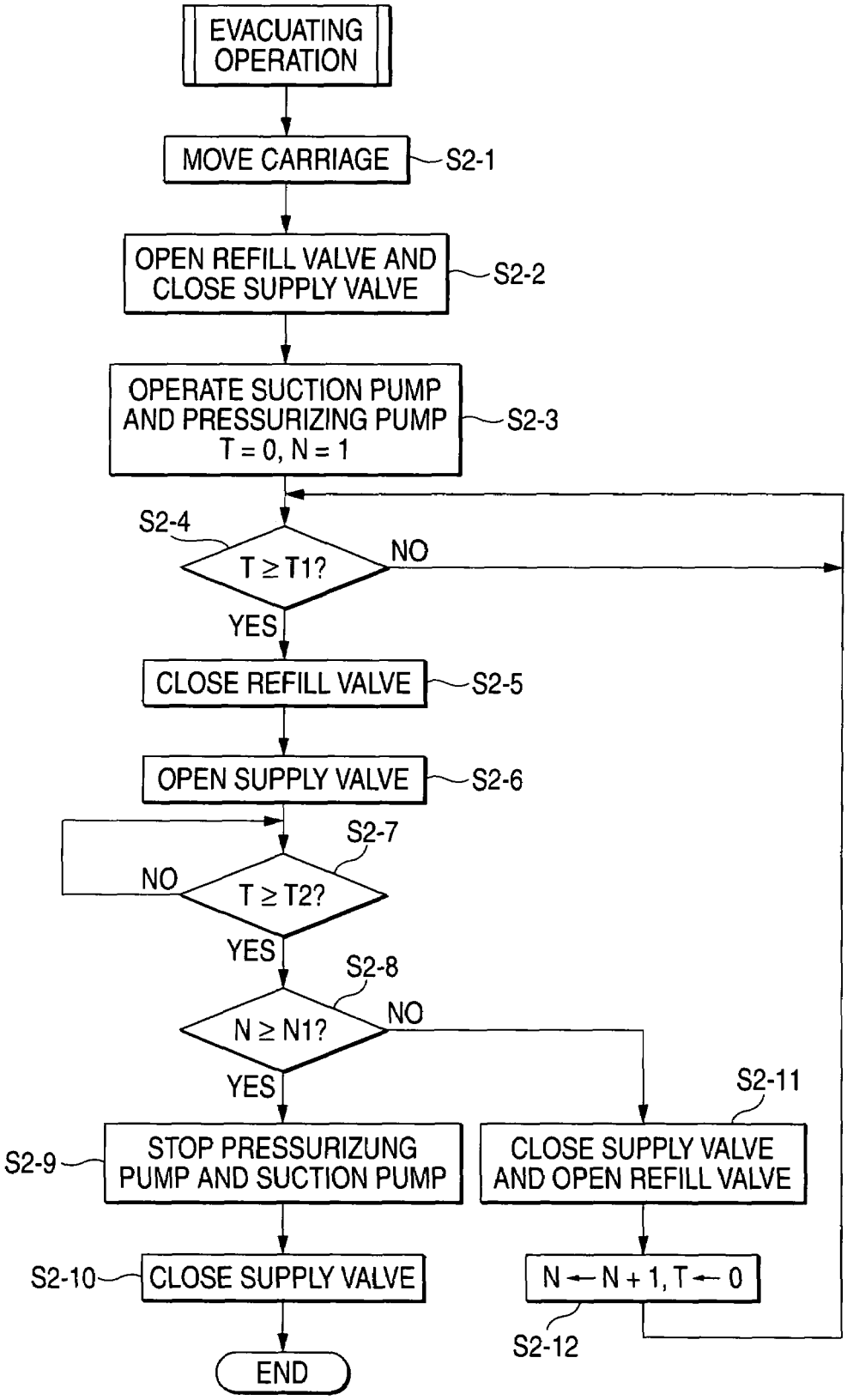
FIG. 6 is a flowchart showing a procedure of evacuating operation in the embodiment.

Referring to FIG. 6, the details of a procedure of the ink evacuating operation will be described below. When a signal for starting the exhaust of ink is output, the carriage 3 is moved to the non-printing area and the capping member 10 seals the nozzle formation face 30*a* of the recording head 30 mounted on the carriage 3 (S2-1). The refill valve 27 is opened and the supply valve 28 is closed (S2-2).

Next, the suction pump 11 and the pressurizing pump 21 start their operation. A value of elapsed time T from starting the operation of the suction pump 11 is reset to 0, and a value of the evacuating operation times N in which the supply valve 28 and the refill valve 27 are opened/closed is set to 1 (S2-3). At this time, the supply valve 28 is closed, as ink and air on the downstream side of the supply valve 28 are sucked by the suction pump 11, pressure is gradually reduced on the downstream side of the supply valve 28 and negative pressure is accumulated. After pressurized air sent by the pressurizing pump 21 flows into the space S of the evacuation cartridge 31 via the air intake 31*a*, it flows out via the air outlet 31*b* and is supplied to the refill tube 4. Ink remained in the refill tube 4 is sent and gathered to the subtank 5 by the pressurized air. As the flow velocity of the pressurized air at this time is fast enough, an ink droplet adhered to the inside wall of the refill tube 4 is also moved to the subtank 5. As the pressurized air that flows into the subtank 5 is discharged from the air vent 22 formed in the subtank 5, pressure inside the subtank 5 is kept equal to atmospheric pressure.

Next, it is judged whether elapsed time T from starting of the operation of the suction pump 11 is equal to or longer than predetermined time T1 or not (S2-4). In case the elapsed time T is below T1 (NO in S2-4), the step S24 is repeated until the elapsed time T is equal to or longer than the predetermined time T1. In case the elapsed time T is equal to or longer than the predetermined time T1 (YES in S2-4), the refill valve 27 is closed (S2-5). That is, the sending of the pressurized air to the refill tube 4 is stopped. At this time, air pressurized by the pressurizing pump 21 continues to flow into the space S of the evacuation cartridge 31. Therefore, the pressure of the space S increases. When the refill valve 27 is next opened, ink remained in the refill tube 4 is sent to the subtank 5 with large air pressure. At this time, when the pressure of the space S is equal to or exceeds predetermined pressure, the pressurizing pump 21 is stopped based on the pressure detector 19. Bubbles are caused inside the subtank 5 by sending pressurized air to the refill tube 4. As the sending of pressurized air is stopped in S2-5, no more bubbles are caused.

When the refill valve 27 is closed, the supply valve 28 is opened (S2-6). At this time, negative pressure accumulated on the downstream side of the supply valve 28 and suction force by the suction pump 11 act upon the nozzle formation face 30*a* of the recording head 30. Therefore, relatively large suction force is applied to ink in the subtank 5 and the ink is sucked in the capping member 10 via the recording head 30. The sucked ink is gathered in the waste liquid tank 12. Therefore, bubbles caused in the subtank 5 are evacuated out of the recording head by the suction pump 11.

Next, it is judged whether elapsed time T since the operation of the suction pump 11 is started is equal to or longer than predetermined time T2 (T2≧T1) or not (S2-7). When the elapsed time T is equal to or no longer than the predetermined time T2, it is judged whether the evacuating times N in which operation for sucking and evacuating residual ink from the side of the recording head 30 is executed is a predetermined times N1 or not (S2-8) after the steps S2-4 to S2-6, that is, after the residual ink is collected in the subtank 5 by pressurized air. N1 denotes 2 or an integer larger than 2, however, N1 is set to 1 and evacuating operation may be also executed only once.

In case operation for sucking and evacuating ink is executed N1 or more times (YES in S2-8), the suction pump 11 and the pressurizing pump 21 are stopped (S2-9), the supply valve 28 is closed (S2-10) and the evacuating operation is finished. In the meantime, in case the evacuating times N of is below N1 (NO in S2-8), the supply valve 28 is closed, the refill valve 27 is opened (S2-11), an initial value 0 is input to T and the evacuating times N is incremented by 1 (S2-12). The steps S2-4 to S2-8 are repeated until the evacuating times N becomes N1.

Ink in the refill tube 4 is intermittently repeatedly sent and collected into the subtank 5 by repeating such operation. Ink in the subtank 5 and the recording head 30 is intermittently sucked by negative pressure caused in the suction pump 11.

According to the ink-jet printer equivalent to the above-mentioned embodiment, the following effect can be acquired.

(1) In the embodiment, pressurized air is sent from the pressurizing pump 21 to the refill tube 4 via the evacuation cartridge 31 having the space S inside. Therefore, an ink droplet adhered to the inside wall of the refill tube 4 can be evacuated from the refill tube 4 with air pressure and the evacuating performance of ink can be enhanced. As ink is not evacuated by flowing back according to the gravity, no bubble is mixed with deaerated ink in the ink cartridge 15 and the quality of ink can be kept satisfactory.

(2) In the embodiment, ink evacuated by pressurized air sent via the evacuation cartridge 31 is ejected from the recording head 30 and is collected in the waste liquid tank 12 via the capping member 10. Therefore, another waste liquid tank for replacing ink is not required to be separately provided.

(3) In the embodiment, after pressurized air is sent to the refill tube 4 in evacuating operation, the sending of pressurized air is halted and operation for suction by the suction pump 11 is repeated. That is, pressurized air is intermittently sent to the subtank 5 via the refill tube 4. Therefore, after bubbles in the subtank 5 caused by the sending of pressurized air are sucked, pressurized air is sent again. Therefore, no bubble is accumulated in the subtank 5 and bubbles can be efficiently evacuated.

(4) In the embodiment, the shape of the evacuation cartridge 31 is formed like that of the ink cartridge 15 and the evacuation cartridge can be replaced with the ink cartridge 15. Therefore, pressurized air generated by the pressurizing pump 21 can be directly guided into the refill tube 4 via the evacuation cartridge 31. The evacuation cartridge 31 can be housed in the holder 32 for housing the ink cartridge 15 and a holder for the evacuation cartridge 31 is not required to be separately provided.

(5) In the embodiment, the filter 31*c* is provided in the evacuation cartridge 31. Therefore, dust mixed in pressurized air sent from the pressurizing pump 21 can be prevented from being mixed in the refill tube 4.

(6) In the embodiment, the IC memory 31*d* is attached to the evacuation cartridge 31 and the data communication device 35 is provided on the guide plate 34. Therefore, when a cartridge is set, it can be discriminated whether the cartridge is the evacuation cartridge 31 or not. Besides, as pressurized air is taken in case the identification information of the evacuation cartridge 31 is detected, wrong operation by a user can be prevented.

The embodiment may be also modified as follows.

In the embodiment, in the steps S2-3 to S2-8 in evacuating operation, the pressurizing pump 21 is always operated. Except this, after the refill valve 27 is closed (S2-5), the pressurizing pump 21 is halted and the refill valve is opened (S2-11), the pressurizing pump 21 may be also operated. The efficiency of energy can be enhanced by such a procedure.

Figure 7:
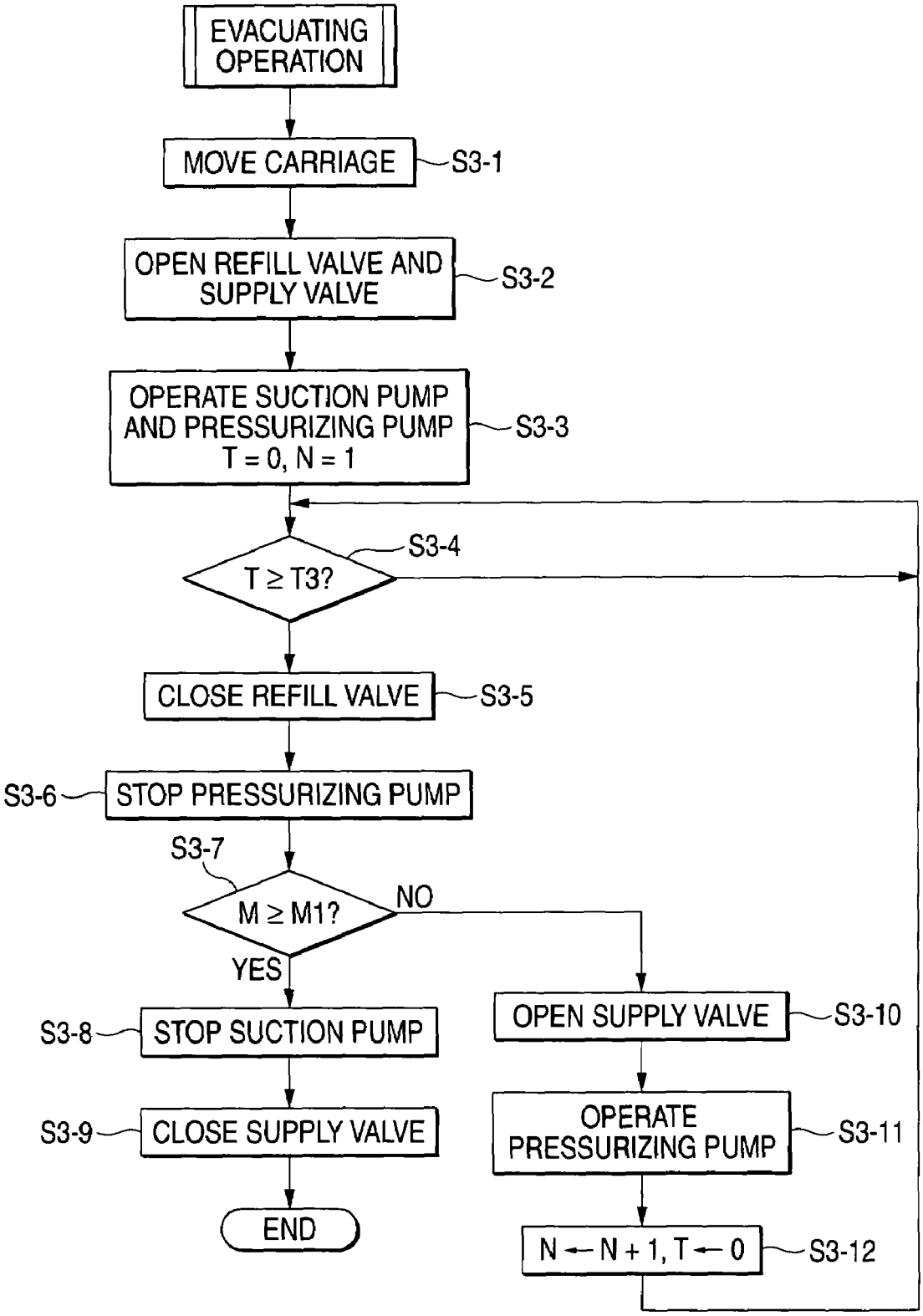
FIG. 7 is a flowchart showing a procedure of evacuating operation in another example.

In the embodiment, in evacuating operation, operation for sending residual ink in the refill tube 4 to the subtank 5 by pressurized air and operation for sucking residual ink in the subtank 5 are alternately executed. Except this, operation for sending residual ink to the subtank 5 and operation for sucking residual ink may be also simultaneously executed. Referring to FIG. 7, this procedure will be described below.

In evacuating operation, first, the carriage 3 is moved to the non-printing area (S3-1). The refill valve 27 and the supply valve 28 are opened (S3-2). Next, the suction pump 11 and the pressurizing pump 21 are operated. Besides, a value of the elapsed time T since the suction pump 11 starts operation is reset to 0 and a value of the frequency M of sending ink to the subtank 5 by pressurized air is set to 1 (S3-3). Next, it is judged whether elapsed time T since the operation of the suction pump 11 is started is equal to or longer than predetermined time T3 or not (S3-4). When the elapsed time T is below the predetermined time T3, judgment is repeated until the elapsed time reaches the predetermined time T3. When the elapsed time T is equal to or longer than the predetermined time T3, the refill valve 27 is closed (S3-5) and the sending of pressurized air to the supply tube 29 is stopped. The pressurizing pump 21 is stopped (S3-6). At this time, suction operation by the suction pump 11 on the side of the recording head 30 is continued and residual ink in the subtank 5 is sucked. Next, it is judged whether the frequency M of sending is equal to or more than a predetermined frequency M1 or not (S3-7). M1 shall be 2 or an integer more than 2. If the frequency M of sending is the predetermined frequency M1 or more, the suction pump 11 is stopped (S3-8), the supply valve 28 is closed (S3-9) and the evacuating operation is finished. If M is below M1, the refill valve 27 is opened (S3-10) and the pressurizing pump 21 is operated (S3-11). Further, an initial value 0 is input to T and 1 is incremented to M (S3-12). The steps S3-4 to S3-7 are repeated until the frequency M of sending reaches the predetermined frequency M1.

Ink in the refill tube 4 is intermittently repeatedly sent to the side of the subtank 5 by repeating such operation and is collected in the subtank. Ink in the subtank 5 and the recording head 30 is always sucked by the suction pump 11.

In the embodiment, the filter 31*c* of the evacuation cartridge 31 is provided around the air outlet 31*b*, however, the filter may be also provided around the air intake 31*a*. The filter may be also provided to both the air intake 31*a* and the air outlet 31*b*.

In the embodiment, the IC memory 31*d* is provided as identifier, however, another may be also used for identifier. For example, a bar code may be also used.

In the embodiment, the shape of the evacuation cartridge 31 is formed like that of the ink cartridge 15. However, if the evacuation cartridge 31 has size that can be housed in the holder 32, it may be also formed in size smaller than the ink cartridge 15 and may be also formed in a different shape.

In the embodiment, when the evacuation cartridge 31 is set and identification information is detected, evacuating operation is started, however, after the identification information is detected, the execution of evacuating operation may be also verified by a user. In this case, when the identification information is detected, a sentence for verifying the execution of evacuating operation is displayed on a screen of the display and the computer not shown. The user makes evacuating operation execute by pressing the switch or operating the computer. Wrong operation can be more securely prevented by such a procedure.

In the embodiment, the ink-jet printer is used for the liquid ejecting apparatus, however, the invention may be also applied to a liquid ejecting apparatus for ejecting liquid except ink. For example, the invention may be also applied to a liquid ejecting apparatus for ejecting liquid such as electrode material and color material used for manufacturing a liquid crystal display, an EL display and a field emission display (FED), a liquid ejecting apparatus for ejecting a biogenic organic substance used for manufacturing a biotip and a sample ejecting system as a precision pippet.

What is claimed is:

1. A liquid ejecting apparatus, comprising:

a main tank, storing liquid;

a liquid ejecting head, ejecting the liquid toward a target;

a liquid supply passage, connecting the main tank with the liquid ejecting head for supplying the liquid;

a subtank, storing the liquid and supplying the liquid to the liquid ejecting head, and the subtank provided on the liquid supply passage; and a pressurizing unit supplying pressurized air to the liquid supply passage so that liquid in the liquid supply passage is evacuated to the subtank.

2. The liquid ejecting apparatus as set forth in claim 1, wherein the liquid evacuated to the subtank is evacuated in a waste liquid tank via a capping member configured to cap the liquid ejecting head.

3. The liquid ejecting apparatus as set forth in claim 1, wherein the pressurizing unit supplies the pressurized air intermittently.

4. The liquid ejecting apparatus as set forth in claim 1, further comprising an evacuation tank for evacuating liquid from the liquid supply passage and receiving the pressurized air from the pressurizing unit, wherein the liquid is ejected by replacing the main tank with the evacuation tank.

5. The liquid ejecting apparatus as set forth in claim 4, wherein the shape of the evacuation tank is the same as that of the main tank.

6. The liquid ejecting apparatus as set forth in claim 4, wherein a filter is provided in the evacuation tank.

7. The liquid ejecting apparatus as set forth in claim 4, wherein the main tank and the evacuation tank are provided with identifying members respectively, each of the identifying members has identification information for identifying each tank; and wherein the liquid ejecting apparatus is provided with a reading member for reading the identification information of the identifying member.

8. The liquid ejecting apparatus as set forth in claim 1, further comprising a carriage, reciprocating in a direction of the width of the target, wherein the liquid ejecting head and the subtank are mounted on the carriage.

9. An evacuation tank for evacuating liquid used in a liquid ejecting apparatus, said liquid ejecting apparatus comprising: a main tank configured to store liquid, a liquid ejecting head configured to eject liquid toward a target, a liquid supply passage configured to supply the liquid in the main tank to the liquid ejecting head, a subtank, provided on the liquid supply passage, configured to store the liquid on the liquid supply passage and supplying the liquid to the liquid ejecting head, and a pressurizing unit configured to supply pressurized air to the main tank:

wherein the main tank is replaceable with the evacuation tank and is connected to the liquid supply passage; and wherein the pressurized air is supplied to the liquid supply passage through the evacuation tank so that liquid in the liquid supply passage is evacuated to the subtank.

10. The evacuation tank as set forth in claim 9, wherein the shape of the evacuation tank is the same as that of the main tank.

11. The evacuation tank as set forth in claim 9, wherein the evacuation tank is provided with a filter.

12. The evacuation tank as set forth in claim 9, wherein the evacuation tank is provided with an identifying member having identification information for identifying the tank.

13. A method of evacuating liquid of a liquid ejecting apparatus, comprising the steps of:

storing liquid at a main tank;

ejecting liquid toward a target at a liquid ejecting head;

supplying the liquid in the main tank to the liquid ejecting head via a liquid supply passage;

storing the liquid at a subtank and supplying the liquid to the liquid ejecting head from a subtank, wherein the subtank is provided on the liquid supply passage; and supplying pressurized air to the liquid supply passage so that liquid in the liquid supply passage is evacuated to the subtank.

14. The method as set forth in claim 13, wherein the liquid ejecting head and the subtank are mounted on a carriage which reciprocates in a direction of the width of the target.

15. The method as set forth in claim 13, wherein the pressurized air is intermittently supplied to the liquid supply passage in the supplying step.

16. The method as set forth in claim 13, further comprising the step of replacing the main tank with an evacuation tank for supplying the pressurized air to the liquid supply passage.

17. The method as set forth in claim 16, wherein the shape of the evacuation tank is the same as that of the main tank.

18. The method as set forth in claim 16, further comprising the step of filtering the pressurized air in the evacuation tank.

19. The method as set forth in claim 16, further comprising the step of identifying which of the main tank and the evacuation tank is attached on the liquid ejecting apparatus.

20. The method as set forth in claim 19, further comprising the steps of:

providing identifying members on the main tank and the evacuation tank respectively;

providing a reading member on the liquid ejecting apparatus;

reading identification information stored in the identifying member to identify each of the tanks.

21. The method as set forth in claim 19, wherein the supplying step is performed when the evacuation tank is identified in the identifying step.

22. The method as set forth in claim 21, wherein the supplying step is performed after a signal for verifying an execution of liquid evacuation is received.

23. The method as set forth in claim 13, further comprising evacuating the liquid in the subtank to a waste liquid tank via a capping member configured to cap the liquid ejecting head.

24. The method as set forth in claim 23, wherein the supplying step and the evacuating step are simultaneously executed.

25. The method as set forth in claim 23, wherein the supplying step and the evacuating step are alternately executed.

* * * * *